United States Patent [19]

Tucker

[11] 4,128,840

[45] Dec. 5, 1978

[54] RESONANT RE-ENTRANT CAVITY WHIP ANTENNA

[76] Inventor: William Tucker, 1965 S. Ocean Dr., Apt. 18-S, Hallandale, Fla. 33009

[21] Appl. No.: 757,994

[22] Filed: Jan. 10, 1977

[51] Int. Cl.[2] ..... H01Q 1/32; H01Q 9/18

[52] U.S. Cl. ..... 343/715; 343/722; 343/750; 333/83 R

[58] Field of Search ..... 333/82 B, 83 R; 343/722, 860, 861, 862, 790, 791, 853, 750, 792, 715

[56] References Cited

U.S. PATENT DOCUMENTS

| | | | |
|---|---|---|---|
| 2,167,201 | 7/1939 | Dallenbach | 333/82 B |
| 2,509,253 | 5/1950 | Schriefer | 343/790 |
| 2,513,761 | 7/1950 | Tyson | 333/83 R |
| 2,603,754 | 7/1952 | Hansen | 333/82 B |
| 2,644,089 | 6/1953 | Bliss | 343/862 |
| 2,941,204 | 6/1960 | Bailey | 343/850 |
| 3,293,646 | 12/1966 | Brueckmann | 333/82 |
| 3,750,181 | 7/1973 | Kuecken | 343/790 |

*Primary Examiner*—Eli Lieberman

[57] ABSTRACT

This invention relates generally to a $\frac{5}{8}$ wave mobile whip antenna using a re-entrant resonant cavity as an electrically and physically integral component to obtain a narrow bandwith necessary to attenuate off channel interference. One embodiment is a coaxial type of re-entrant cavity resonator as an electrically and physically integral part of a $\frac{5}{8}$ wave whip antenna. A second embodiment is a hybrid type of re-entrant cavity resonator referred to as a helical cavity resonator as an electrically and physically integral part of a $\frac{5}{8}$ wave whip antenna.

5 Claims, 6 Drawing Figures

RESONANT RE-ENTRANT CAVITY WHIP ANTENNA

BACKGROUND OF THE INVENTION

This invention relates to radio antennas and more particularly to a highly unique type of $\frac{5}{8}$ wavelength two-way radio antenna designed as the solution to a chronic radio interference problem encountered by amateur radio operators using two-way mobile radio communications in the 146–148 Mhz portion of the 2 meter amateur radio band. For brevity, this band will be referred to as the 146 Mhz band.

The source of the chronic interference referred to above, is due to commercial, government and broadcast stations operating at frequencies above and below the 146 Mhz band. A very frequent and major source of interference is from the 150 to 170 Mhz frequency band where there are hundreds of radio channels assigned to two-way radio communication systems such as in use by business radio, telephone company, police and fire departments, hospital and ambulance, taxicab, municipal, county, state, federal, marine ship to shore et al. Other sources of interference to the 146 Mhz band receivers are aircraft two-way radio operating in the 110 to 140 Mhz band, F.M. broadcast stations in the 88–108 Mhz band and the television broadcast channels above 170 Mhz. These operations normally should not cause interference in 146 Mhz band radio receivers, providing that the receiving equipment is selective enough in design and construction to provide ample attenuation to all unwanted radio frequencies. However, in too many cases, mainly because of manufacturing cost considerations and space limitation, the receiving equipment is not adequate in that respect.

Most of the interference is caused by the close proximity and/or high intensity of the interfering radio signal getting into the R.F. input circuit, commonly known as the "front end" of the radio receiver, thereby mixing with other external and internal signals, causing what is known as intermodulation product interference, usually referred to as "intermod." These unwanted signals getting into the front end of the radio receiver can also cause overloading or blocking and will tend to greatly reduce the sensitivity of the receiver, preventing the reception of all but the strongest desired signals. This condition is referred to as "desensitization."

A common method that has been very successful in minimizing or completely eliminating the types of interference discussed, has been the use of cavity resonators as highly selective narrow bandpass filters placed at the receiver RF input terminals, or incorporated as an integral part of the radio receiver. Basically, a cavity resonator is an enclosure or partial enclosure of any size and shape, having conducting walls or surfaces that can support oscillating electromagnetic fields within it and possesses certain resonant frequencies when excited by electrical oscillations. The basic paper on cavity resonators was presented by W.W. Hansen, "A Type of Electrical Resonator," Journal of Applied Physics, Vol. 9, page 654, October 1938.

The most common type of cavity resonator used in the type of interference elimination discussed above, is the re-entrant cavity resonator, consisting of a $\frac{1}{4}$ wavelength inner conductor placed concentrically in a cylinder type enclosure. One end of the inner conductor is connected to one end plate and the other end is left open, but in close proximity to the other end plate.

Resonance at a particular frequency is achieved by mechanical adjustment of the length of the inner conductor within the cavity housing. Often, to conserve space, the entire assembly is shortened to less than a $\frac{1}{4}$ wavelength and an adjustable capacitor is added to the normally open end to tune the cavity to resonance. The re-entrant type of cavity can be further reduced in size by coiling the inner conductor into a small helix and placed within a small cavity housing. We then have a hybrid type of re-entrant cavity referred to as a helical cavity resonator. Two such resonators are often coupled together for greater selectively. One of the basic papers on this type of resonator was presented by W. Macalpine and R. Schildknecht, "Coaxial Resonators with Helical Inner Conductor," Proceedings of the Institute of Radio Engineers, December 1959, page 2099.

The input and output circuits of the re-entrant cavity are usually designed to match the impedance of commonly used 50 ohm coaxial cable. This is done by providing small pick-up loops placed in the electromagnetic field or by direct connection to the inner conductor. Higher impedance inputs and/or output can be obtained by using larger pick-up loops or by tapping directly to the inner conductor at higher impedance points. A combination of both are often used. Re-entrant type cavity resonators can be designed in various sizes, shapes and configurations. The interior surface of the cavity housing and the exterior surface of the inner conductor should afford high conductivity of electric currents. The inner conductor can be solid, hollow, round, square or flat and either be of $\frac{1}{4}$ wave resonant in length or, if shorter, be tuneable to the desired resonant frequency. The various types of re-entrant cavities have acquired many descriptive names. To name a few; resonant cavity, resonant bandpass filter, cavity resonator, coaxial bandpass filter, coaxial filter, coaxial tank, trough-line filter, combine filter, interdigital bandpass filter, stripline filter, helical cavity resonator, helical resonator, et al. They all have one thing in common; they are all in the resonant cavity family and can be used to provide highly selective bandpass filtering.

Conventional inductance and capacitor type of resonant circuits made up of lumped circuit constants are not practical for use in bandpass filters at very high frequencies (VHF) to obtain the degree of selectivity required to eliminate intermod and desensitization type of interference. In many cases they carry descriptive names which could be confused with re-entrant resonant cavities, such as bandpass filter, resonator, tank circuits et al. However, they all have one thing in common; they are not in the resonant cavity family.

Coaxial cables, when cut to an electrical $\frac{1}{4}$ wave or $\frac{1}{2}$ wave in length, or multiples, are often used as resonant circuits. They are neither lumped constant resonant circuits nor are they in the resonant cavity family but bridge the gap between them.

When both input and output circuits are provided for in a re-entrant type of cavity, the circuit is equivalent to a parallel resonant circuit offering high impedance bandpass characteristics to the desired resonant frequency. Conversely, when only one input is used, the circuit becomes the equivalent of a series resonant circuit and offers very low impedance to the resonant frequency and is usually used as a wave trap or suck-out filter.

A combination of the two types of useages is usually where the transmitter and receiver are both used simultaneously and fairly close in frequency such as in repeater type of operation or for duplex telephone operation. This combination is usually referred to as a duplexer.

Cavity resonators are often used as a tank circuit in a radio transmitter, or externally to it, to prevent radiation of spurious emmissions and to prevent re-radiations of unwanted signals that might gain entry otherwise.

In 146 Mhz mobile two-way radio communication, as used by radio amateurs, one of the most widely used antennas is the $\frac{5}{8}$ wave whip antenna. The reason for its popularity is because it concentrates most of the radiated energy into the low angles so desirable for transmission and reception at this frequency. The higher angle radiation pattern of the conventional $\frac{1}{4}$ wave ground plane whip antenna wastes a great deal of energy into space. Unfortuantely, a $\frac{5}{8}$ wave whip antenna will not resonate without the addition of inductive reactance. Therefore this type of antenna is manufactured using a small series coil at its base, usually sealed in a plastic housing and designed for a particular band of frequencies. In many cases the coil is made tuneable to the desired operating frequency band, by introducing capacity and varying one in respect to the other or both as is the case of the variable sleeve type of base coil where the sleeve is moved over the coil in micrometer fashion to resonate the antenna. All these antennas are of the broad band variety and do not in any way act to reduce intermod or desensitization type of interference.

SUMMARY OF THE INVENTION

This invention relates generally to a two-way mobile radio $\frac{5}{8}$ wave whip antenna using a re-entrant resonant cavity as an electrically and physically integral component to obtain a narrow bandwidth necessary to attenuate off channel interference. This is accomplished by eliminating the conventional broad band series inductance coil assembly connect used in $\frac{5}{8}$ whip antennas and replacing it with a specially designed re-entrant type of resonant cavity that adds little to the cost of producing the antenna, and will not only provide a simple means of resonating the antenna with a simple screwdriver adjustment, but will provide an excellent impedance match to the coaxial cable feedline. There are two preferred embodiments of this invention. A first embodiment is a coaxial type of re-entrant cavity resonator as an electrically and physically integral part of a $\frac{5}{8}$ wave whip antenna. A second preferred embodiment uses a hybrid type of re-entrant cavity resonator referred to as a helical cavity resonator as an electrically and physically integral part of a $\frac{5}{8}$ wave whip antenna.

It is an object of this invention to solve the chronic interference problem by providing a $\frac{5}{8}$ wave whip antenna with very narrow bandpass characteristics by using a re-entrant type of cavity resonator as an electrically and physically integral part of the antenna to tune the antenna to resonance instead of the usual broad band inductance type as heretofore commonly used.

It is another object of this invention to provide a two-way mobile radio $\frac{5}{8}$ wave whip antenna that will reduce or completely eliminate intermod and/or desensitization type of radio interference encountered by amateur radio operators in the 146 Mhz frequency band.

Another object of this invention is to provide antenna means that will allow the user of inexpensive two-way radio communication equipment that is highly vulnerable to intermod and/or desensitization type of interference, to use such equipment in high density interference areas with good results.

It is another object to fill the anticipated huge need for this invention that will exist when and if Citizen Band Radio is allocated frequencies in the VHF or UHF bands. Mass produced inexpensive and highly competitive two-way radio communication equipment is highly vulnerable and will need this type of antenna to allow the user to communicate without intereference.

Another object of this invention is to provide a resonant re-entrant cavity whip antenna.

A further object of this invention is to provide a re-entrant cavity resonator as an electrically and physically integral part of a $\frac{5}{8}$ wave whip antenna.

An additional object of this invention is to provide a hybrid type of re-entrant cavity resonator as an electrically and physically integral part of a $\frac{5}{8}$ wave whip antenna.

In accordance with these and other objects which will be apparent hereinafter, the instant invention will now be described with particular reference to the accompanying drawings.

DESCRIPTION OF THE PREFERRED EMBODIMENT

Figure 2:
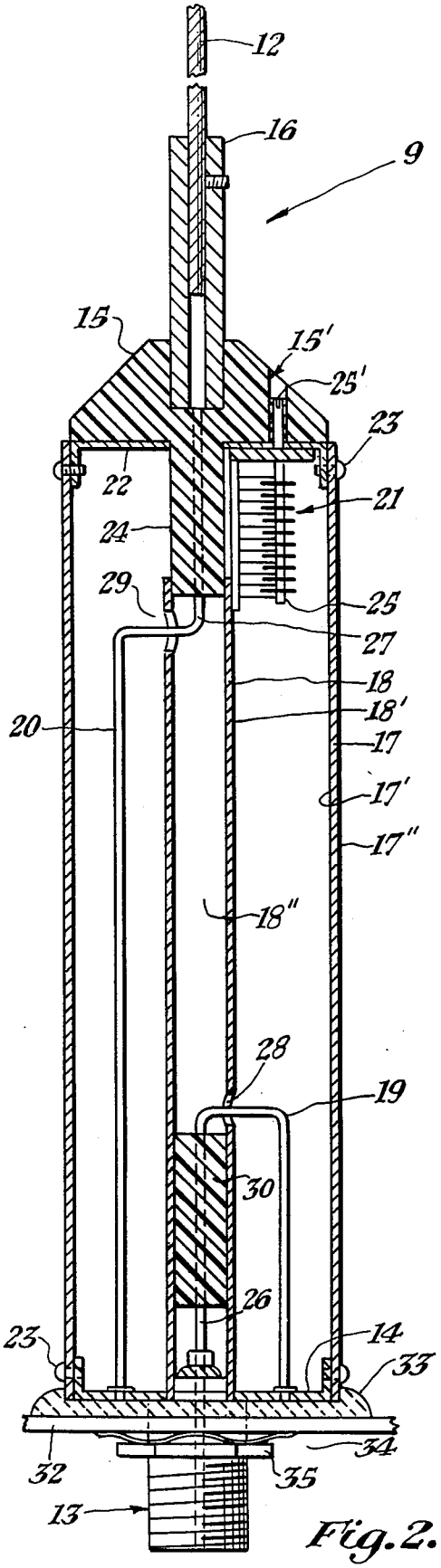
FIG. 2 is a cross-sectional view of the device shown in FIG. 1.
Figure 1:
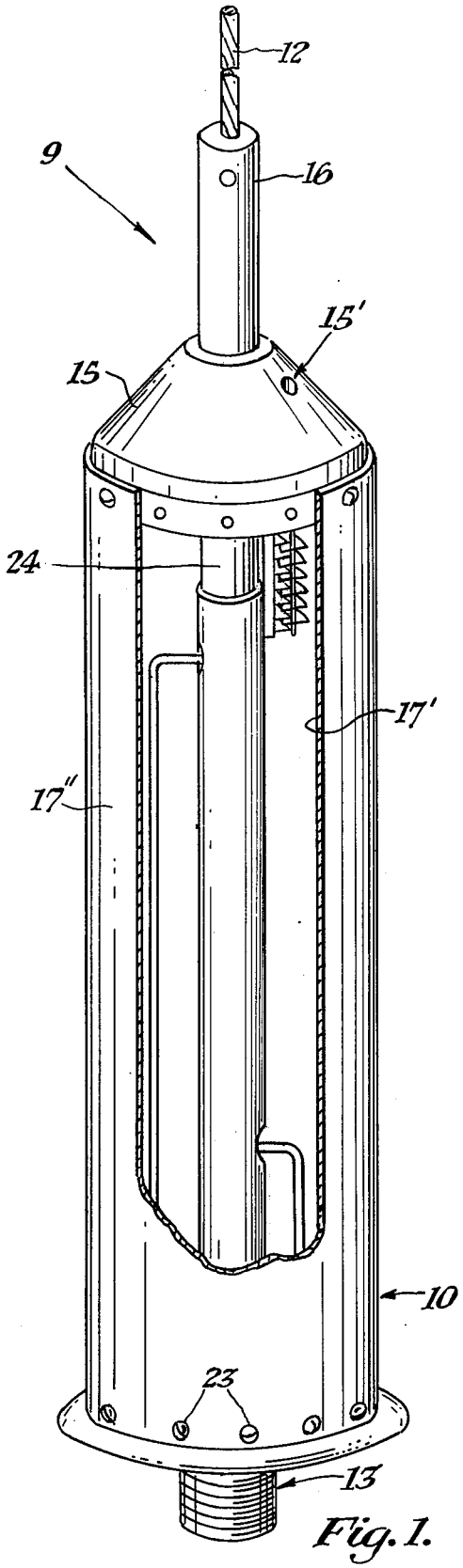
FIG. 1 is an illustration of one embodiment of a device partially broken away.
Figure 3:
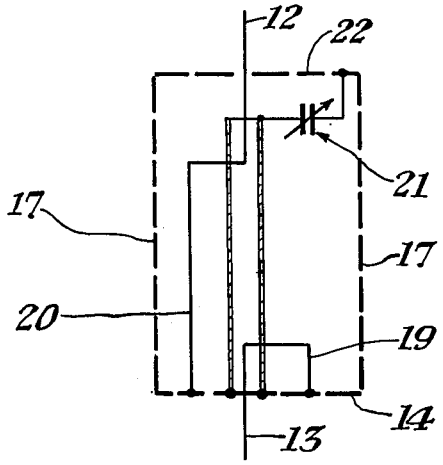
FIG. 3 is a schematic drawing of the circuit of the device shown in FIGS. 1 and 2.

One of the preferred embodiments of this invention is shown in FIGS. 1, 2 and 3. FIG. 1 is in perspective view, FIG. 2 is in cross-section, and FIG. 3 is a schematic drawing of the circuit. In this embodiment, a coaxial type of re-entrant resonant cavity is used as an electrically and physically integral part of a $\frac{5}{8}$ wavelength two-way mobile radio whip antenna designed to operate in the 146 Mhz amateur radio frequency band. The main feature of this invention is to provide an antenna that is capable of reducing or completely eliminating the chronic interference problem encountered by radio amateurs operating in the 146 Mhz. frequency band, i.e.; intermodulation and densensitization. This antenna 9 provides a highly selective relatively narrow bandpass filtering action to a desired band of frequencies to the exclusion of undesired adjacent frequency bands that are outside of the bandpass. By virtue of design considerations which involve the physical dimensions and internal configurations of the resonant cavity, the narrowness of the antenna bandpass can be controlled, the input and output impedance can be controlled and the resonant frequency of the cavity can be set precisely in the desired frequency band by a simple screwdriver adjustment 25'. The radiating portion of this antenna consists of a $\frac{5}{8}$ wavelength flexible stainless steel whip antenna rod 12 with a high conductivity plating. The $\frac{5}{8}$ wavelength is chosen because it provides a maximum of radiation at relatively low angles which are so advantageous in line-of-sight communication which prevails in 146 Mhz mobile or fixed station operation. A $\frac{5}{8}$ wavelength whip antenna rod 12 is a non-resonant radiator and requires the addition of inductive reactance to achieve resonance. In this antenna, the required reactance is supplied when the attached cavity is tuned to resonance. In addition, the entire antenna, when tuned to resonance, matches the impedance of the commonly used 50 ohm coaxial cable for maximum transfer of energy.

Referring to FIGS. 1, 2 and 3, the physical appearance of this antenna is designed for symmetry and balance and is built in a concentric fashion where the coaxial cable feedline socket 13 is centered with the bottom end plate 14 of body 10 and the $\frac{5}{8}$ wave whip antenna rod 12 is centered with the top insulator 15. This configuration is pleasing to the eye and resembles the usual $\frac{5}{8}$ wave whip antenna externally. The coaxial cable socket 13 serves as the input when the antenna is being used for transmission and conversely as the output when used for reception. To avoid confusing terms in this description, the word "input" will be used to designate the coaxial cable socket 13 and its associated coupling circuit, and the word "output" will be used to designate the receptacle 16 for the whip antenna rod 12 and its associated coupling circuit.

In this antenna 9, the basic cavity resonator consists of a metallic cylinder housing 17, an inner conductor 18, two pick-up loops 19 and 20 and a variable capacitor 21 and associated hardware and insulation.

The principal of operation of the re-entrant resonant cavity is well known to those skilled in the art. Basically, an oscillating electromagnetic field is produced in the cavity as a result of excitation by the transmitter or by a received radio signal. The pick-up loops 19 and 20 are the means of coupling into and out of the cavity. The resonant frequency is determined by the physical dimensions involved.

Referring to FIGS. 1, 2 and 3 the cavity housing cylinder 17 is less than a $\frac{1}{4}$ wave in length and the inner conductor 18 is slightly shorter. The top and bottom of the cavity cylinder is closed in with metal plates 14 and 22 and fastened 23 securely electrically and mechanically. The inner conductor 18 of rigid metal tubing is electrically and mechanically fastened to the bottom plate 14 and insulated from the top plate by an insulating extension 24 of the top insulator 15. The top insulator 15 is made of high dielectric material such as Teflon and is used to serve as mechanical support to hold the inner conductor 18 steady and firm and to provide a support for the whip receptacle 16. The top insulator 15 is sloping to allow for rainwater drainage.

A variable capicator 21 is connected between the top end of the inner conductor 18 and the top plate 22 and is used to tune the cavity to resonance. Access to the tuning shaft 25 is through a water tight opening 15' in the top insulator 15 just large enough to admit a small screwdriver.

Skin Effect at the frequencies involved in this antenna cause the R.F. currents to flow on the surface of the conductors only; therefore it is important that the interior surfaces 17' of the cavity enclosure 17 be of high conductivity. All electrical contact must be rigid and tight. The outside surface 18' of the inner conductor and the surfaces of the pick-up loops 19 and 20 carry R.F. currents and should also be of high conductivity. The outside surface of the cavity housing 17'' carries no R.F. currents and can be grounded. Likewise the inside surface 18'' of the inner conductor 18 carries no R.F. currents. In order to conveniently provide connections to the two pick-up loops 19 and 20 and maintain the concentric symmetrical configuration, the input 26 and output leads 27 to the loops 19 and 20 are inside of the inner conductor tubing 18. Small exit opening 28 and 29 are provided on the inner conductor 18 as the feed-through points for the pick-up loops 19 and 20. The input lead 26 is insulated 30 from the inner conductor 18 tubing and is designed so that the inside surface 18'' of the tubing 18 and the lead 26 itself form a short section of coaxial cable and in effect, bring the 50 ohm coaxial feedline right up to the point of exit 28 into the cavity as a pickup loop 19. The output lead 27 from the whip receptacle 16 runs through the top insulator 15 down through the inner conductor 18 and exits 29 as a pick-up loop 20. The exposed portion of the pick-up loops 19 and 20 are situated in the electromagnetic field that exists in the cavity when excited. Both loops 19 and 20 are electrically connected to the bottom plate 14.

The selectivity of the antenna is determined by the degree of coupling in and out of the cavity. Increasing the area of the loop 19 and 20 will result in an increased coupling and less selectivity. Conversely, decreasing the size of the area of the loop 19 and 20 will reduce the coupling and increases the selectivity. The input and output impedances are also dependent on the size of the loops 19 and 20; larger loop area provides higher impedance and conversely, smaller areas provide lower impedance. Also, as the selectivity is increased the insertion losses in the cavity increases. All of the physical dimensions of the cavity and its internal parts and their physical relation to each other are interdependent in regards to resonant frequency, impedance, selectivity and insertion losses.

The antenna is designed to be mounted on a vehicle 32 using the coaxial cable socket 13 as a mounting stud. A rubber gasket 33 is used to prevent water seepage into the vehicle. An external lock washer 34, preferably having sharp contact edges (not shown), is used under the fastening nut 35 to bite into the vehicle metal body 32 to provide a sure ground connection. The vehicle body 32 acts as a ground plane for the antenna. This antenna can also be used at a base station by the addition of four ground radials slightly longer than $\frac{1}{4}$ wavelength each to act as the ground plane. The antenna is tuned to resonance when mounted in its permanent position by noting the lowest standing wave ratio on the coaxial feedline with a S.W.R. bridge placed in the line. Resonance indication can also be obtained by noting the maximum output on a field strength meter.

Figure 5:
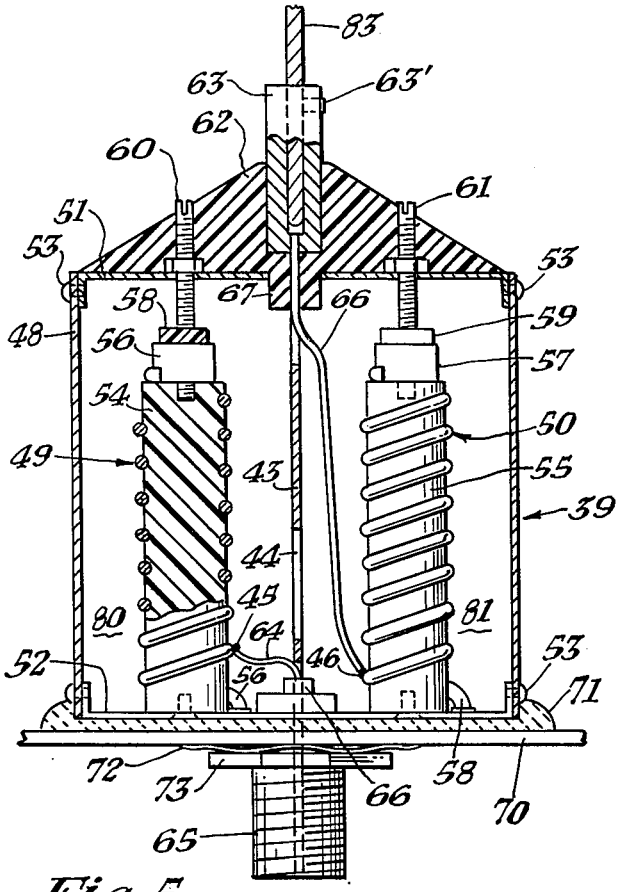
FIG. 5 is a cross-sectional view of the device shown in FIG. 4.
Figure 4:
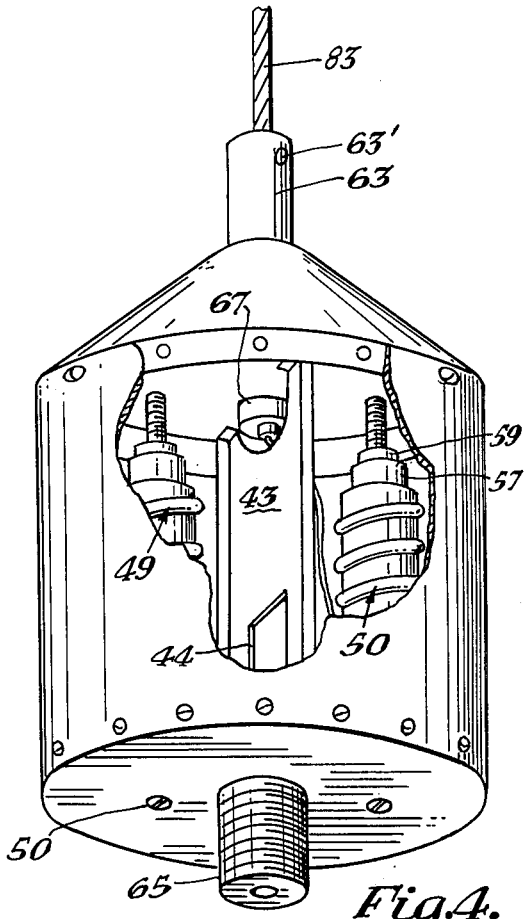
FIG. 4 is an illustration of the second embodiment of a device partially broken away.
Figure 6:
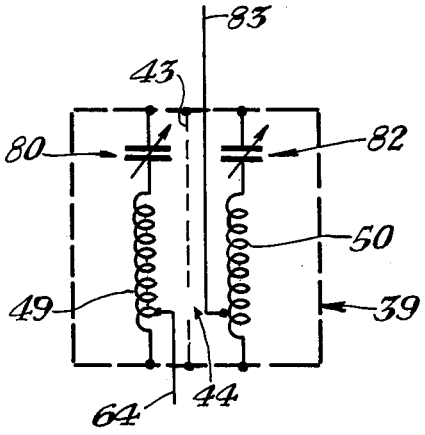
FIG. 6 is a schematic drawing of the circuit of the device shown in FIGS. 4 and 5.

The other preferred embodiment of this invention is shown in FIG. 5, in cross section view and FIG. 4 in perspective view and FIG. 6 in a schematic diagram embodiment. A hybrid type of re-entrant resonant cavity referred to as a helical cavity resonator, is used as an electrically and physically part of a $\frac{5}{8}$ wavelength mobile two-way radio antenna designed for operation in the 146 Mhz amateur radio frequency band. The main feature of this invention is to provide an antenna that is capable of reducing or completely eliminating the chronic interference problem encountered by radio amateurs operating in the 146 Mhz frequency band ie; intermodulation and densensitization. This antenna provides a highly selective relatively narrow bandpass filtering action to a desired band of frequencies to the exclusion of undesired adjacent frequency bands that are outside of the bandpass. By virtue of design considerations which involve the physical dimensions and internal configuration of the resonant cavity, the narrowness of the antenna bandpass can be controlled, the input and output impedance can be controlled and the resonant frequency of the cavity can be set precisely in the desired frequency band by simple screwdriver adjustments of screws 60 and 61.

The radiating portion of this antenna consists of a ⅝ wavelength flexible stainless steel whip antenna rod 83 with a high conductivity plating. The ⅝ wavelength is chosen because it provides a maximum of radiation at relatively low angles which are so advantageous in line-of-sight communication which prevails in 146 Mhz mobile or fixed station operation. A ⅝ wavelength whip antenna 83 is a non-resonant radiator and requires the addition of inductive reactance to achieve resonanae. In this antenna, the required reactance is supplied when the attached cavity is tuned to resonance. In addition, the entire antenna, when tuned to resonance, is designed to match the impedance of the commonly used 50 ohm coaxial cable for maximum transfer of energy. The physical appearance of this antenna is designed for symmetry and balance, and is built in a concentric fashion where the coaxial cable feedline socket 65 is centered with bottom end plate 52 and the ⅝ whip 83 is centered with the top insulator 62. This configuration is pleasing to the eye and its external appearance resembles some of the presently used ⅝ whip antennas. The coaxial cable socket 65 serves as the input when the antenna is being used for transmission and conversely as the output, when used for reception. To avoid confusing terms in this description, the word "input" will be used to designate the coaxial cable socket 65 and its associated coupling circuit, and the word "output" will be used to designate the receptacle for the whip radiator 83 and its associated coupling circuit.

Referring now to FIGS. 4, 5 and 6, in this antenna, the basic cavity resonator consists of a metallic oval shaped cylinder housing 39, two inner conductors 49 and 50, two plunger capacitors, a partition and associated hardware and insulation. The hybrid type of reentrant resonant cavity is well known to those skilled in the art. Basically, an oscillating electromagnetic field is produced in one of the two adjacent cavities as a result of excitation by the transmitter or by a received signal. The other cavity is coupled to the electromagnetic field of the excited cavity by a window-like opening 44 in the partition 43 that divides the two cavities 80 and 81. Direct electrical connection 45 and 46 to each of the helical inner conductors 49 and 50 is the means of coupling into and out of this cavity assembly. The resonant frequency is determined by the physical dimensions involved.

In this hybrid configuration, the inner conductor 49 and 50 is reduced in size by coiling it into a small helix 49 and 50, thereby requiring a small cavity housing 39. Two such small cavities 80 and 81 are coupled together through a window-like opening 44 in the partition 43.

Referring to FIGS. 4, 5 and 6, the cavity housing cylinder 48, oval in shape, is considerably shorter than the other preferred embodiment. The inner conductors 49 and 50 are coiled into small helixes 49 and 50 a little shorter in length than the cavity housing cylinder 48. The top 51 and bottom 52 of the cavity cylinder is closed in with metal plates and fastened 53 securely electrically and mechanically. The inner conductor helixes 49 and 50 are made of solid copper wire and are wound around grooved forms of high dielectric material 54 and 55 such as Teflon. The bottom of each helix is electrically attached to the bottom plate 52 at 56 and 58 and the grooved insulator form 54 and 55 are mechanically attached to the bottom plate.

At the top of each helix 49 and 50 there is a small metal sleeve 56 and 57 which serves as part of the adjustable tuning capacitor. The adjustable tuning capacitors are shown as 80 and 82. A metal threaded rod 60 and 61 electrically connected to the top plate 51 is the plunger part of the capacitor and is accessible through the top insulator 62. The dielectric of the capacitors are 58 and 59. The top insulator 62 of high dielectric material such as Teflon serves as mechanical support and insulation for the whip receptacle 63. The top insulator 62 is sloped for rainwater drainage. A set screw 63' is used to hold the whip 83 in place.

Skin effect at the frequencies involved in this antenna cause the R.F. currents to flow on the surface of the conductors only; therefore it is important that the interior surfaces of the cavity enclosures be of high conductivity. All electrical connections and contacts must be rigid and tight. The outside surface of the cavity housing carries no R.F. currents and can be grounded to the vehicle.

The output lead 66 extends from a tap 46 on the output helix 50 up through a small feedthrough section 67 of the top insulator 62 and connects to the whip receptacle 63. The input lead 64 extends from the connection 66 on the coaxial cable socket 65 up to a tap 45 on the input coil 49.

The metal partition 43 is fastened electrically and mechanically to the top and bottom plates as well as to the cylinder housing and has high conductivity surfaces. A windowlike opening 44 provides the coupling between the two cavity sections.

The degree of coupling is proportional to the size and placement of the window opening 44. Greater coupling produces lower selectivity and lower insertion loss. Less coupling conversely produces higher selectivity and greater insertion loss. The impedance of input and output circuits are determined by the position of the electrical tap 45 and 46 on the helix 49 and 50. The impedance is lowest at the bottom end and highest at the top.

All of the physical dimensions of the cavity and its internal components and their physical relation to each other are interdependent in regards to frequency of resonance, input and output impedance, selectivity and insertion loss.

The antenna is designed to be mounted on a vehicle 70 using the coaxial cable socket 65 as a mounting stud. A rubber gasket 71 is used to prevent water seepage into the vehicle 70. An external lock washer 72 is used under the fastening nut 73 to bite into the vehicles metal body 70 to provide a good ground connection. The vehicle body 70 acts as a ground plane for the antenna.

This antenna can also be used at a base station by the addition of four ground radials slightly longer than ¼ wavelength each to act as the ground plane.

The antenna is tuned to resonance when mounted in its permanent position by noting the lowest standing wave ration on the coaxial feedline with an S.W.R. bridge placed in the line. Resonance indication can also be obtained by noting the maximum output on a field strength meter.

The main features of this invention is to provide an ⅝ wave whip antenna that will reduce or completely eliminate the chronic interference problem encountered by radio amateurs operating in the 146 Mhz band, i.e.; intermodulation and desensitization. However, it is to be clearly understood that the embodiments shown are examples only and not as limitations to the scope of this invention. Also, in line with the object and main features of this invention, it should be clearly understood that this antenna can be used for the purposes specified anywhere in the 50 Mhz to 1000 Mhz frequency range, in mobile or fixed station use, for amateur, commercial or government use, and the radiating element is not limited to the example shown of $\frac{5}{8}$ wavelength whip, but can be any non-resonant length, vertical or horizontal and single element or multi-element.

This antenna is not limited to use in the 146 Mhz band but can be used effectively in the range of 50 Mhz to 1000 Mhz.

This antenna is not to be confused with the various types of microwave slot antennas, horn antennas, waveguide antennas, cavity backed slots, and coaxial sleeve antennas.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A re-entrant type of cavity resonator whip antenna comprising the combination of:

a base mounted re-entrant cavity, a five eighths wave whip antenna coaxially mounted on said cavity and electrically coupled thereto whereby said antenna is resonated, bandpass filtered, and impedance matched to the transmission line.

2. A re-entrant type of cavity resonator whip antenna as set forth in claim 1 wherein:

said resonator is a coaxial type of re-entrant cavity resonator.

3. A re-entrant type of cavity resonator whip antenna as set forth in claim 1 wherein:

said resonator is a helical re-entrant cavity resonator.

4. A re-entrant type of cavity resonator whip antenna as set forth in claim 2 including:

a housing means including an antenna connecting means connected to said whip antenna, a metallic cylinder housing, an insulator connected to and between said metallic cylinder housing and said antenna, an inner conductor, a housing base connected between the base of said metallic cylinder housing and the base of said inner conductor, two pick-up loops, one said pick-up connected between the input and said housing base, the other said pick-up connected between said housing base and said antenna and positioned between said metallic cylinder housing and said inner conductor, and a capacitor connected between the upper portion of said metallic cylinder housing and said upper portion of said inner conductor

5. A re-entrant type of cavity resonator whip antenna as set forth in claim 3 including:

a housing means including an antenna connecting means connected to said whip antenna, a metallic cylinder housing, an insulator connected to and between said metallic cylinder housing and said antenna, two helical coils, two capacitors each connected to one end of one said helical coil, an inner partition with a window means, a housing base connected between said inner partition, said metallic cylinder housing and each helical coil, a housing top connected between said inner partition, said metallic cylinder housing and the other end of each said capacitor, and one said coil connected to the input and the other said coil connected to said antenna.

* * * * *